US009809440B2

(12) United States Patent
Kellerman

(10) Patent No.: US 9,809,440 B2
(45) Date of Patent: Nov. 7, 2017

(54) COMBINATION DISPENSER DRINKING CUP HOLDER AND DRIP COLLECTOR APPARATUS

(71) Applicant: Dallas Kellerman, Belleville, IL (US)

(72) Inventor: Dallas Kellerman, Belleville, IL (US)

( * ) Notice: Subject to any disclaimer, the term of this patent is extended or adjusted under 35 U.S.C. 154(b) by 9 days.

(21) Appl. No.: 15/042,604

(22) Filed: Feb. 12, 2016

(65) Prior Publication Data

US 2016/0340169 A1 Nov. 24, 2016

Related U.S. Application Data

(60) Provisional application No. 62/165,436, filed on May 22, 2015.

(51) Int. Cl.
*B67D 1/16* (2006.01)
*B67D 3/00* (2006.01)

(52) U.S. Cl.
CPC ..... *B67D 1/16* (2013.01); *B67D 3/009* (2013.01); *B67D 3/0054* (2013.01); *B67D 2210/00065* (2013.01)

(58) Field of Classification Search
CPC ..... B67D 1/16
USPC ..... 141/86–88; 222/108; 248/312, 312.1, 248/315, 311.2, 316.8
See application file for complete search history.

(56) References Cited

U.S. PATENT DOCUMENTS 400,358 A * 3/1889 Page ..... B67D 1/16 222/108
699,481 A * 5/1902 Boyd ..... B67D 1/16 137/313
1,703,284 A * 2/1929 Wolfe ..... B67D 1/16 137/312
4,753,277 A 6/1988 Holcomb et al.
D328,216 S * 7/1992 Steed ..... D6/525
6,619,507 B2 9/2003 Lassota
6,968,979 B2 * 11/2005 Gribble ..... B67D 1/16 141/86
D582,721 S 12/2008 Stange
7,470,364 B2 12/2008 Oranski et al.
D614,442 S 4/2010 Smith
7,959,033 B2 6/2011 Leggett
8,002,146 B2 8/2011 Cahen et al.
8,091,469 B2 1/2012 Cahen et al.
D657,922 S 4/2012 Wolke
D662,417 S 6/2012 Reinhold
8,448,821 B2 5/2013 Hecht
8,695,484 B2 4/2014 Mori
8,931,397 B2 1/2015 Frigeri et al.
(Continued)

OTHER PUBLICATIONS

Cal Mil, DM005 Round Drip Tray Holder with 6 inch drop, retrieved Mar. 11, 2015 from webstaurantstore.com/cal-mil-dm005-drip-minder-with-6-drop/211DM005.html?utm_source=shopping.com&utm_medium=cpc&utm_term=211DM005&utm_campaign=smallwares.

(Continued)

*Primary Examiner* — Timothy L Maust
*Assistant Examiner* — Timothy P Kelly
(74) *Attorney, Agent, or Firm* — Bryan Cave LLP

(57) ABSTRACT

The present disclosure relates to an apparatus and method for conveniently holding a drinking cup while dispensing liquid from a dispenser such as a spigot, filling the cup, and collecting any drips and/or spillage from the dispenser or the drinking cup into a second drip collecting cup.

9 Claims, 11 Drawing Sheets

(56) References Cited

U.S. PATENT DOCUMENTS

| | | | | |
|---|---|---|---|---|
| 2009/0139457 | A1* | 6/2009 | Luong | A01K 63/02<br>119/251 |
| 2015/0053277 | A1 | 2/2015 | Davis | |

OTHER PUBLICATIONS

The Beverage Butler, The Beverage Butler Drip Catcher, retrieved Mar. 12, 105 from amazon.com/The-Beverage-Butler-Drip-Catcher/dp/B004IRDMD8.

* cited by examiner

COMBINATION DISPENSER DRINKING CUP HOLDER AND DRIP COLLECTOR APPARATUS

CROSS REFERENCE TO RELATED APPLICATIONS

This application claims priority to U.S. Provisional Application Ser. No. 62/165,436, filed May 22, 2015, the entirety of which is herein incorporated by reference.

FIELD OF THE DISCLOSURE

The present disclosure relates to an apparatus and method for conveniently holding a drinking cup while dispensing liquid from a dispenser such as a spigot, filling the cup, and collecting any drips and/or spillage from the dispenser or the drinking cup into a drip collecting cup. The apparatus is capable of holding the drinking cup or the drip collecting cup using various shaped tabs and/or collets (if necessary depending upon, for example, the size of the cups) while the drip collecting cup is positioned below the drinking cup holder.

BACKGROUND

While at various events, beverages or other liquids are often served from dispensers including spigots or similar devices which can leak or drip even after the spigot or valve is released or closed. This can cause excessive spillage, beverage waste, or slippery surfaces. Further, at such events, oftentimes one arm and/or hand is occupied holding a child, food plate, cane, or other, which can make it difficult to both hold a cup and dispense a beverage with the remaining hand. Thus, there is a need for an apparatus that is capable of both holding a cup in position for filling from a dispenser and collecting overflow or drips from the dispenser during filling or after the cup is withdrawn.

SUMMARY OF THE DISCLOSURE

The present disclosure addresses the disadvantages of trying to dispense a liquid into a drinking cup while one hand is occupied due to holding a plate, child, or other reason, and the potential for spillage during dispensing or after dispensing is complete. Among the advantages of this disclosure, therefore, is that not only does the apparatus collect spillage from the dispenser once dispensing is complete, but is also capable of holding a drinking cup below the dispenser while it is being filled.

Briefly, therefore, the present disclosure is directed to a combination dispenser cup holder and drip collection apparatus. The apparatus comprises, in combination, a support member upon which a beverage dispenser having a spigot is placed; a front member extending downwardly at a right angle from the support member; first cup-holding member extending outwardly at a right angle from the front member and below the spigot, the first cup-holding member adapted to receive a drinking cup into which liquid from the spigot may be dispensed; and a second cup-holding member extending outwardly at a right angle from the front member and below the first cup-holding member, the second cup-holding member adapted to receive a drip collecting cup into which drips from the spigot may be collected when the drinking cup is not present in the first cup-holding member.

Other objects and features will be in part apparent and in part pointed out hereinafter.

BRIEF DESCRIPTION OF THE DRAWINGS

The details of the present invention, both as to its construction and operation can best be understood with reference to the accompanying drawings, in which like numerals refer to like parts, and in which.

REFERENCE NUMERALS IN DRAWINGS

D—dispenser
S—spigot
C1—drinking cup
C2—drip collecting cup/collector
1—drinking cup holder and drip collector apparatus
2—support member
4—front member
6—first, or upper, cup-holding member
6A and 6B—cup holding tabs

8—second, or lower, cup-holding member
8A—planar member of second, or lower, cup-holding member
8B—opening of second, or lower, cup-holding member
10—gusset
12—collet
14—top flange of collet
16—vertical web of collet
18—straight surface of collet
20—opposite side of collet
22—taper or lead-in of collet
24—bottom flange of collet
26—base slide
28—offset flange
30—flange
32—tensioner
34—tensioner slot
36—front member slot
38—tensioning member
40—cup (holding member) securing tab
42—drip cup/collector support tab

DETAILED DESCRIPTION

It will be readily understood that the features of the present invention, as generally described and illustrated in Figures herein, may be consist of a variety of different configurations. Thus, the following more detailed description of the embodiments of the system and method of the present invention, as represented in FIGS. 1-10, is not intended to limit the scope of the claimed invention, but it is merely representative of the presently preferred embodiments of the invention.

The present disclosure provides an apparatus to conveniently assist in dispensing a liquid beverage into a drinking cup while in combination collecting spillage from the dispenser when the drinking cup is not present or overflow or spillage from the drinking cup when it is present. The apparatus is capable of being held in position by the dispenser atop a surface. The apparatus can be configured to accept and hold various plastic, foam, paper and other drinking cup styles.

Referring to FIGS. 1-6, the apparatus disclosed herein is a combination dispenser drinking cup holder and drip collector apparatus 1. The apparatus 1 is used in connection with a dispenser D having a spigot S or similar device for selectively releasing fluid from the dispenser. In the illustrated embodiment, for example, the dispenser D is a conventional beverage cooler/dispenser having a cylindrical cross section and planar lower surface. It will be understood that the apparatus can be used in connection with any similar dispensing container that is capable of resting on a table, countertop, beverage cart, and the like.

Figure 1:
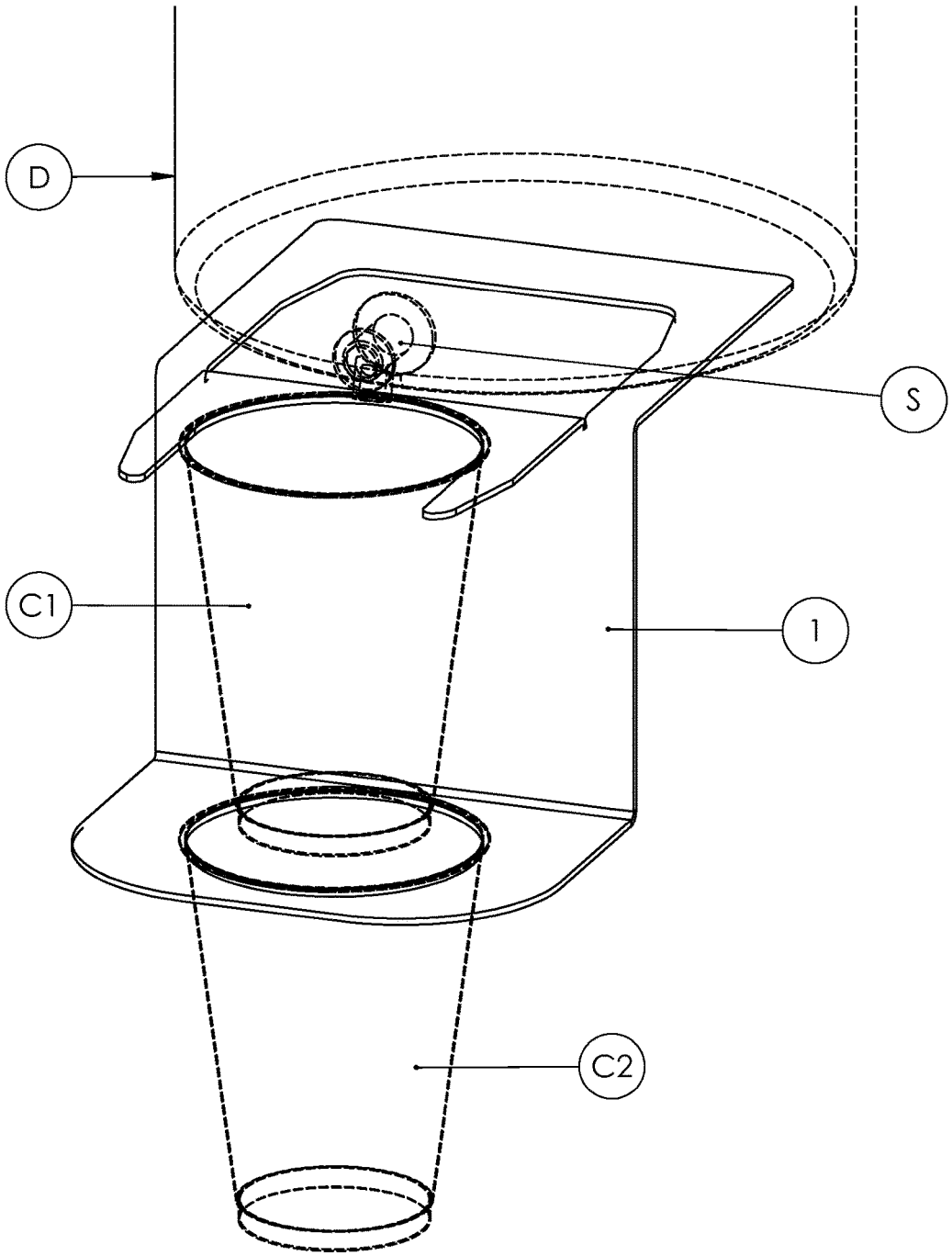
FIG. 1 is a front perspective view of a liquid dispenser having a spigot, a drinking cup, a drip cup/collector, and a dispenser drinking cup holder and drip collector apparatus.
Figure 2:
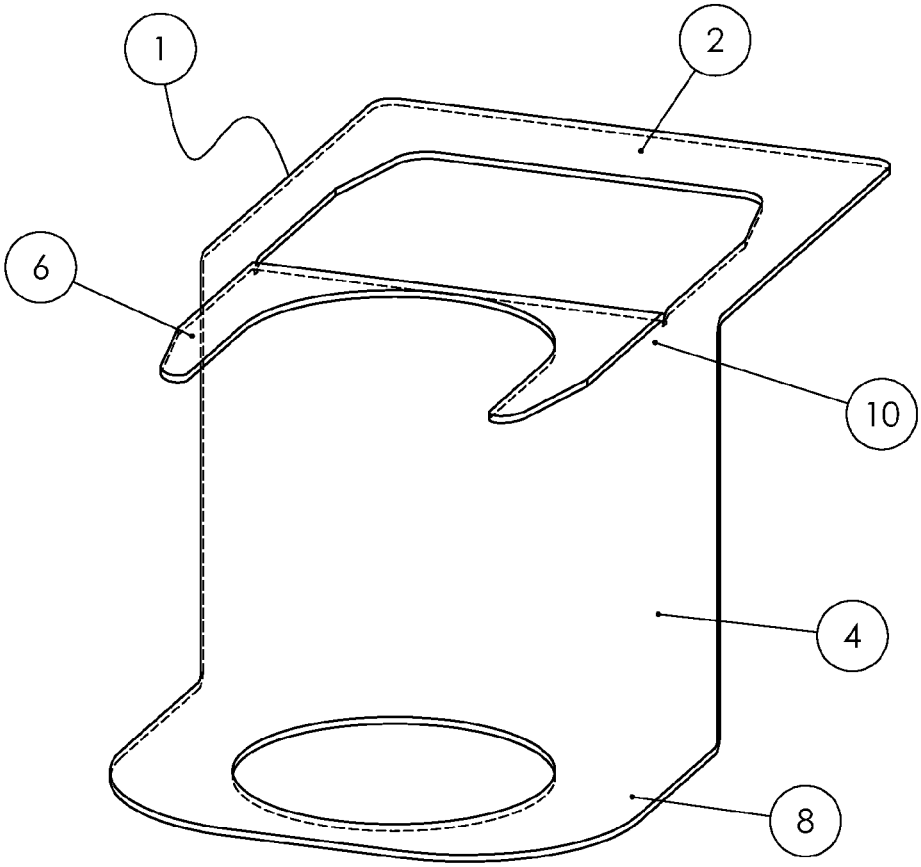
FIG. 2 is a perspective view of a dispenser drinking cup holder and drip collector apparatus in accordance with the invention.

As best shown in FIGS. 1 and 2, the apparatus includes a support member 2 upon which the dispenser D is placed. In some embodiments, the support member can be secured or removably attached to the dispenser D, for example, by Velcro®, snaps, hooks, adhesives, or the like. In other embodiments, the apparatus 1 can be hung from the spigot. In certain preferred embodiments, the weight of the dispenser D is used to secure the support member 2 to a supporting structure such as a table or like structure upon which the dispenser D sits. Depending upon how the apparatus 1 is formed, the support member 2 can have a variety of planar shapes, e.g., rectangular, square, or other shape, including both solid or cut-out portions as depicted in FIGS. 2-7. The support member 2 may also include texturized portions or regions (not shown), e.g., sandpaper-like material or rubberized pads or coatings, to limit sliding of the apparatus 1 and/or the dispenser D on the surface upon which it is placed.

Front member or portion 4 extends downwardly at substantially a right angle from the support member 2. For example, the front member may rest on the front edge of a table or countertop upon which the dispenser D sits. Like the support member 2, depending upon how the apparatus 1 is formed, the front portion 4 have a variety of planar shapes, e.g., rectangular, square, or other shape, including both solid or cut-out portions as depicted in FIGS. 2-6.

Extending outwardly at substantially a right angle from the front member is a first, or upper, cup-holding member 6. In use, the first-cup holding member 6 is positioned below the spigot S of the dispenser D. Member 6 is adapted to receive a drinking cup into which liquid from the spigot may be dispensed. The first cup-holding member 6 may also include texturized portions or regions (not shown), e.g., sandpaper-like material or rubberized pads or coatings, to grip the drinking cup C1 when in place.

In the depicted embodiments, the cup-holding member 6 includes two tabs 6A and 6B positioned generally perpendicularly to the front member 4 and contoured to hold the drinking cup while the liquid is being dispensed. The tabs which hold the drinking cup can have various shapes including, for example, straight parallel, curved (e.g., to keep the cup secure from sliding away from spigot), or the like. In other embodiments (not shown), the first, or upper, cup-holding member can be a planar member having an opening extending therethrough into which the drinking cup can be positioned (that is, similar to the second cup holding member 8 depicted in the Figures and discussed below). In addition, the tabs 6A and 6B or opening can accept various size collets, as needed, to assist in holding other size drinking cups, as discussed in further detail below.

As shown in FIG. 1, the inner distance between tabs 6A and 6B is spaced to receive a drinking cup C1. The cup C1 may be a common size that is readily available, and in some cases, disposable. In general, any disposable or non-disposable drinking cups of the type commonly used with dispensers may be used in connection with the apparatus 1.

Figure 3:
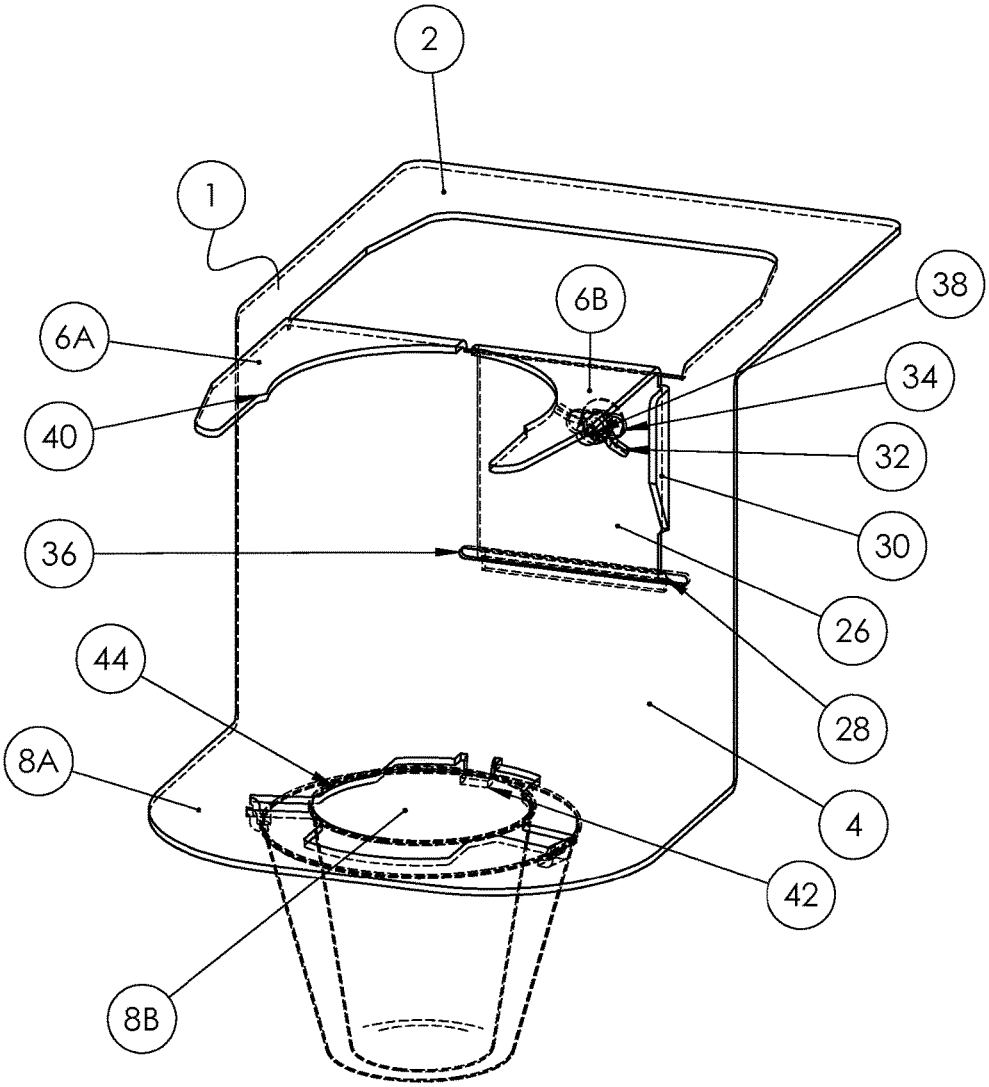
FIG. 3 is an alternative embodiment of a perspective view of a dispenser drinking cup holder and drip collector apparatus with adjustable tab(s). The embodiment of a perspective view can also contain a dispenser drinking cup holder and drip collector apparatus with drinking cup securement and/or the lower drip collector portion containing securement features to contain/support the drip cup.

Referring to FIG. 3, in some embodiments, the tabs 6 may not be a fixed entity to the apparatus base 4. Either or both tabs 6A and 6B of first, or upper, cup-holding member 6 may be adjustable by releasing some means of tensioner 32 to allow the base slide 26 to be repositioned along tensioner slot 34, allowing tab(s) 6A and 6B to support various size drinking cups C1. A front member slot 36 in the front member 4 can accept an offset flange 28 or other shape to assist keeping the base slide 26 parallel with the front member slot 36 and lower cup holding member 8. The front member 4 can also include a tensioning member 38 or other means to assist securing the tensioner 32 against the base slide 26, such as a screw, nut and bolt (including, for example, a wing nut as depicted), and the like. The base slide 26 may include a flange 30 or other extrusion to assist when adjusting base slide 26. In some embodiments, the tab(s) 6 can contain a cup securing tab 40 beyond 180° to assist containment of the drinking cup C1. The lower drip collecting cup/collector member 8 can also include drip cup support tabs 42 to support the flange/rim of drip collecting cup/collector C2 from the underside of the lower drip collector 8 portion. Additionally, or alternatively, the lower drip collector 8 can contain an opening of second, or lower, cup-holding member other than a circle to support the flange/rim of drip collecting cup/collector C2. While the apparatus 1 of FIG. 3 includes both tensioner 32 and related components and tabs 40, 42, it will be understood that one or both of these arrangements can be present in connection with other embodiments depicted in other figures and/or otherwise disclosed herein.

Figure 5:
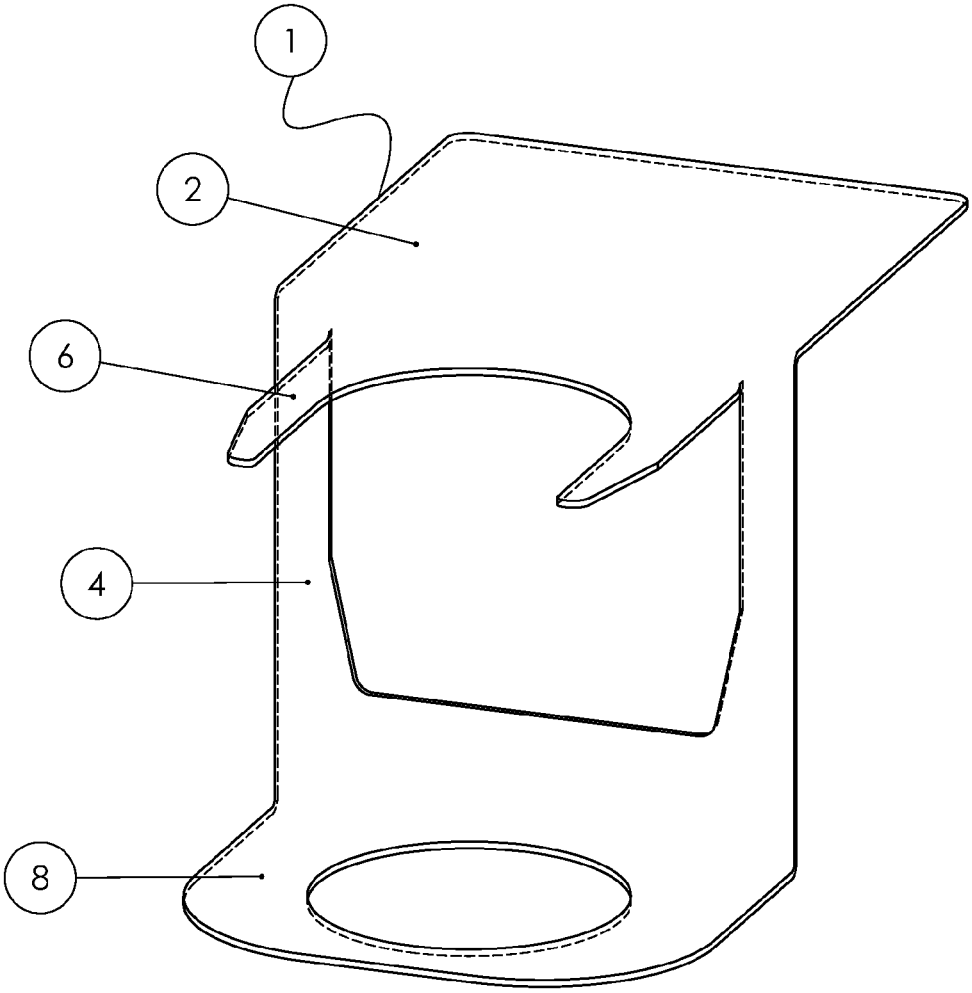
FIG. 5 is an alternative embodiment of a perspective view of a dispenser drinking cup holder and drip collector apparatus with the straight tab(s) of the first cup-holding member in a different plane as the support member in accordance with the invention.
Figure 6:
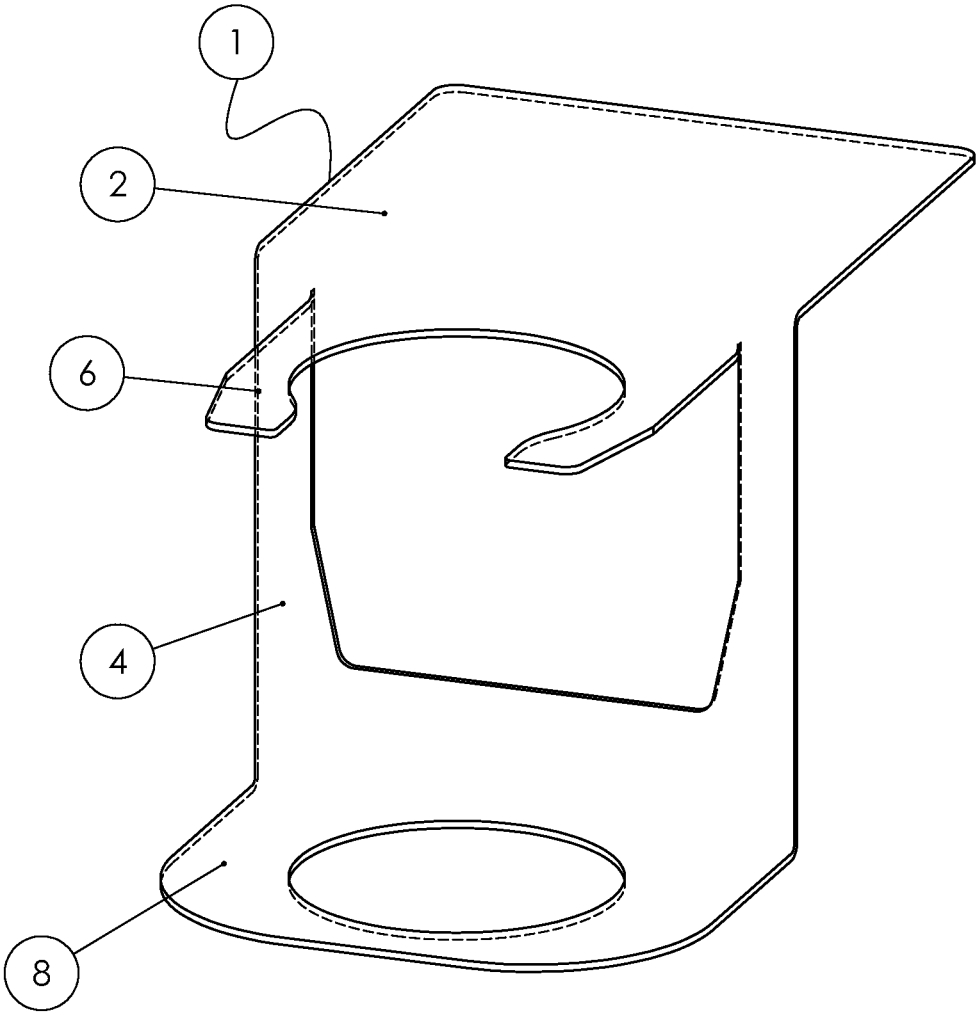
FIG. 6 is an alternative embodiment of a perspective view of a dispenser drinking cup holder and drip collector apparatus with the curved tab(s) of the first cup-holding member in a different plane as the support member in accordance with the invention.

Referring to FIGS. 5 and 6, in some embodiments, the first cup-holding member 6 may not be in the same plane as the support member 2. For example, the first cup-holding member 6 may extend substantially perpendicularly outward from the front member 4 and parallel to the support member 2.

Also extending outwardly at substantially a right angle from the front member, parallel to and positioned below the first cup-holding member, is a second cup-holding member 8. The second cup-holding member is adapted to receive a drip collecting cup/collector C2 into which drips from the spigot may be collected, for example, when the drinking cup C1 is not present in the first cup-holding member or in the case of overflow or spillage from the drinking cup C1. The second cup-holding member 8 may also include texturized portions or regions (not shown), e.g., sandpaper-like material or rubberized pads or coatings, to grip the drip collecting cup/collector C2 when in place.

In the depicted embodiments, the second, or lower, cup-holding member 8 is a planar member 8A having an opening 8B extending therethrough into which the drip collecting cup can be positioned. In other embodiments (not shown), the first, or upper, cup-holding member include two tabs positioned generally in the same plane other and contoured to hold the drip collecting cup (that is, similar to the configuration of the first cup-holding member 6 depicted in the Figures and discussed above). If present, the tabs which hold the drip collecting cup can have various shapes including, for example, straight parallel, curved (e.g., to keep the cup secure from sliding away from spigot), or the like. In addition, the opening 8B or tabs can accept various size collets, as needed, to assist in holding other size drip collecting cups, as discussed in further detail below. It will also be understood that the first and second cup-holding members may have the same or different configurations.

Figure 4:
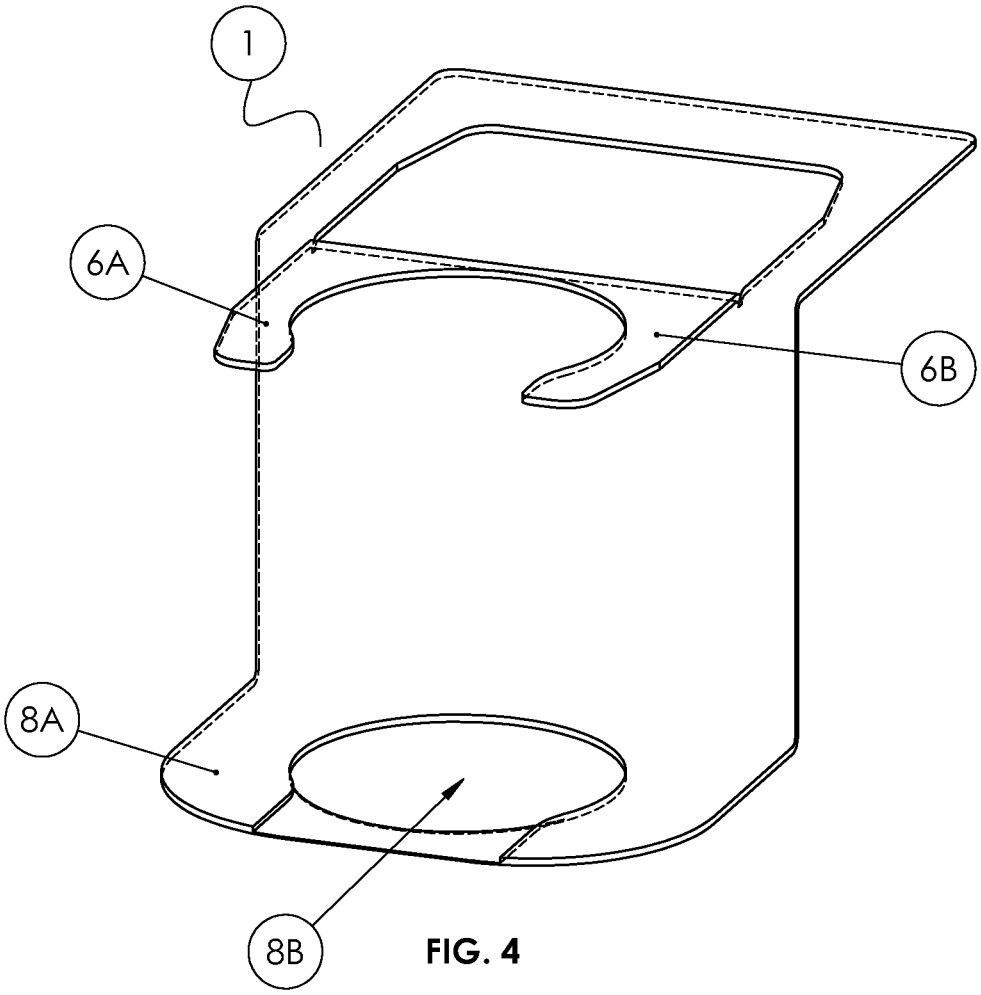
FIG. 4 is an alternative embodiment of a perspective view of a dispenser drinking cup holder and drip collector apparatus.

In some embodiments, the apparatus 1 may include one or more gussets 10 to maintain the tabs 6A/B parallel or at a particular angle to the support member 2. In the illustrated embodiment, for example, the gussets 10 are of a similar material extending between the front portion 4 and the tabs 6A/B. In certain preferred embodiments, the apparatus 1 (including the support member 2, front portion 4, first cup-holding member 6, tabs 6A/B (if present), second cup-holding member 8, planar member 8A and opening 8B (if present), and gussets (if present) are formed monolithically out of the same work piece or material. For example, the apparatus 1 can be formed out of a single sheet of plastic, metal, or other suitable material. As depicted in FIGS. 2-4, the various parts of the apparatus can be formed out of a single piece of material by different combinations of cut-outs and bends.

Figure 7:
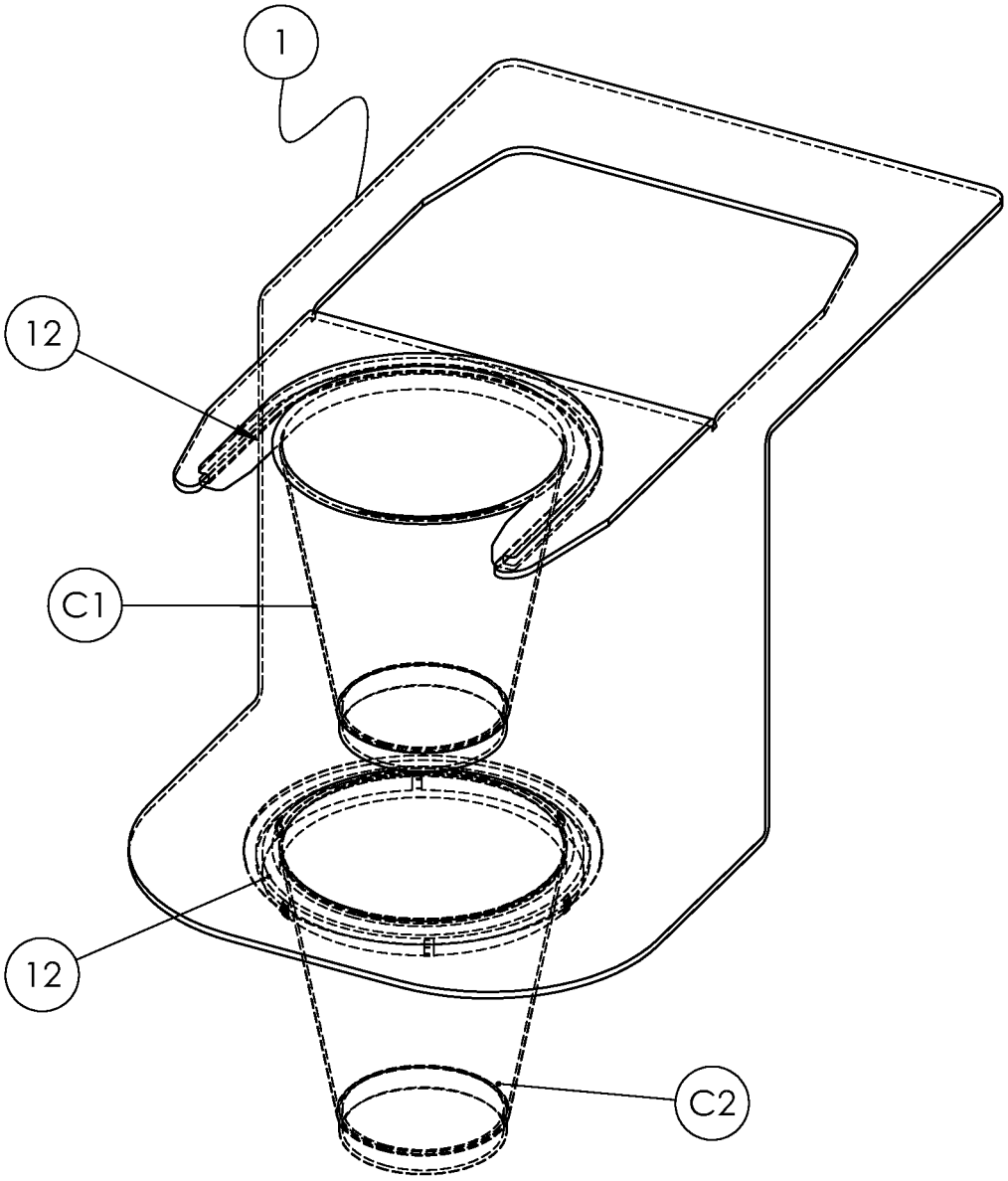
FIG. 7 is a front perspective view of a liquid dispenser having a spigot, a drinking cup, a drip cup, a dispenser drinking cup holder and drip collector apparatus, and a collet(s) which assist in holding other size drinking cups and drip collectors.
Figure 8:
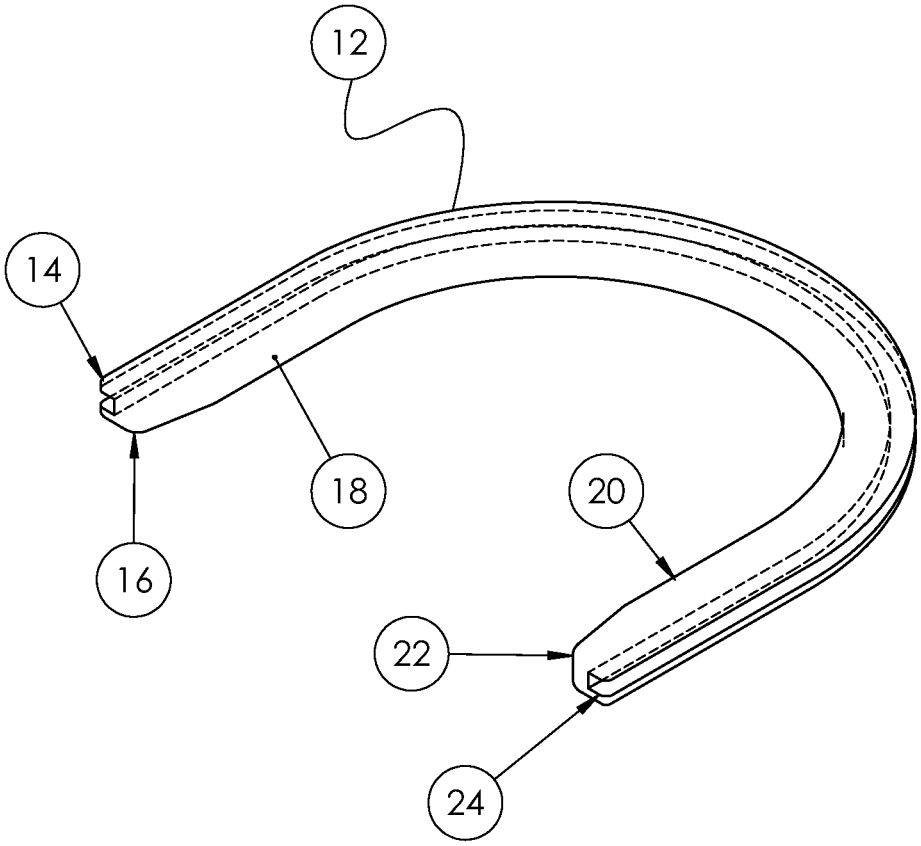
FIG. 8 is a perspective view of a collet used on a dispenser drinking cup holder and drip collector apparatus to adapt and assist holding other size drinking cups in accordance with the invention.

Referring to FIGS. 7 and 8, in some embodiments, the apparatus 1 may be modified to accommodate drinking cups C1 and/or drip collecting cup/collectors C2 of varying sizes and/or shapes. In order to accommodate the different drinking cup sizes, a collet 12 can be used in combination with the apparatus 1. Depending upon the shape and style of the first and second cup-holding members 6, 8 open and closed style collets can be selected and employed.

Figure 9:
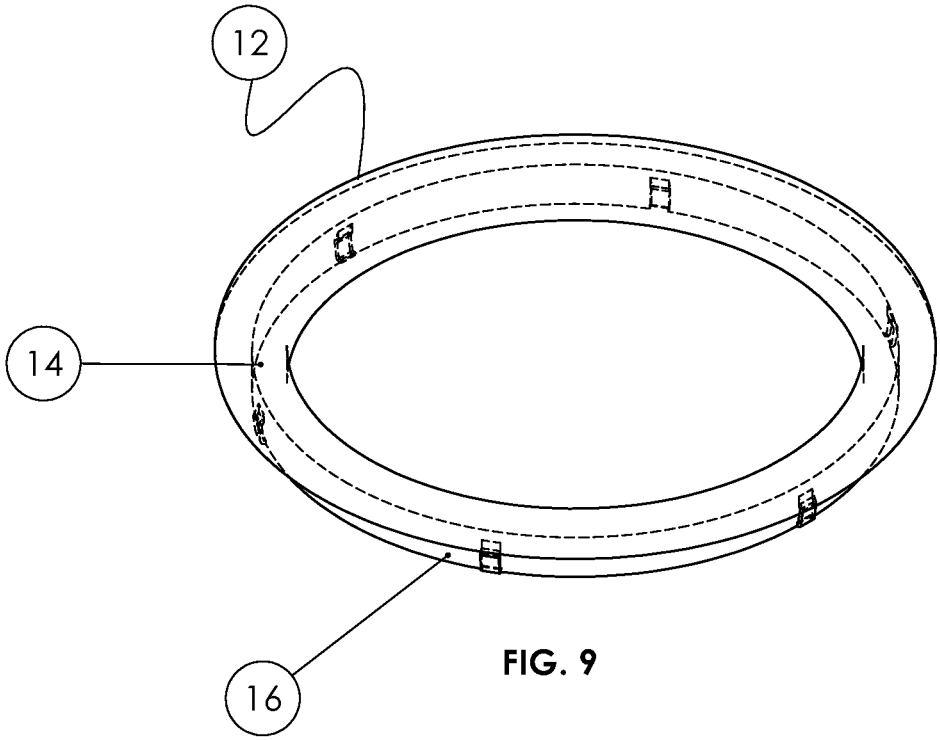
FIG. 9 is a perspective view of a collet used on a dispenser drinking cup holder and drip collector apparatus to adapt and assist holding other size drip collectors in accordance with the invention.

In FIGS. 8 and 9, for example, an open style collet and a closed style collet are depicted, respectively. Regardless of whether an open style or closed style collet, or both, is employed, the material of the collet can be of similar materials of the apparatus 1 or different, i.e., plastic or rubber, or formed of some other material. In the depicted embodiments, the collet 12 includes of a top flange 14 and vertical web 16. Depending upon the perimeter of the said first and/or second cup-holding members 6, 8, the collet 12 may have a straight surface 18 parallel to its opposite side 20 or open angle for compression when installed to keep the collet 12 secure. The open collet 12 may also feature a taper or lead-in 22 to assist in guiding the drinking cup C1 and/or drip collecting cup/collector C2 into position. The collet 12 may also include a bottom flange 24 to assist in keeping the collet 12 in position when installed.

It will be understood that the apparatus 1 may be formed of a single monolithic work piece or material, or may be formed of multiple parts and/or components that are assembled by the manufacturer and/or consumer. With regard to fastening, mounting, attaching or connecting components of the present disclosure to form the apparatus 1 as a whole, unless specifically described otherwise, such are intended to encompass conventional fasteners such as screws, nut and bolt connectors, threaded connectors, snap rings, detent arrangements, clamps such as screw clamps and the like, rivets, toggles, pins, and the like. Components may also be connected by adhesives, glues, welding, ultrasonic welding, and friction fitting or deformation, if appropriate. The apparatus may also be folded or disassembled for cleaning, storage, shipping, packaging, or other purposes. Unless specifically otherwise disclosed or taught, materials for making components of the present invention may be selected from appropriate materials such as metal, metallic alloys, natural and man-made fibers, vinyl's, plastics and the like, and appropriate manufacturing or production methods including casting, pressing, extruding, molding and machining may be used.

Figure 10:
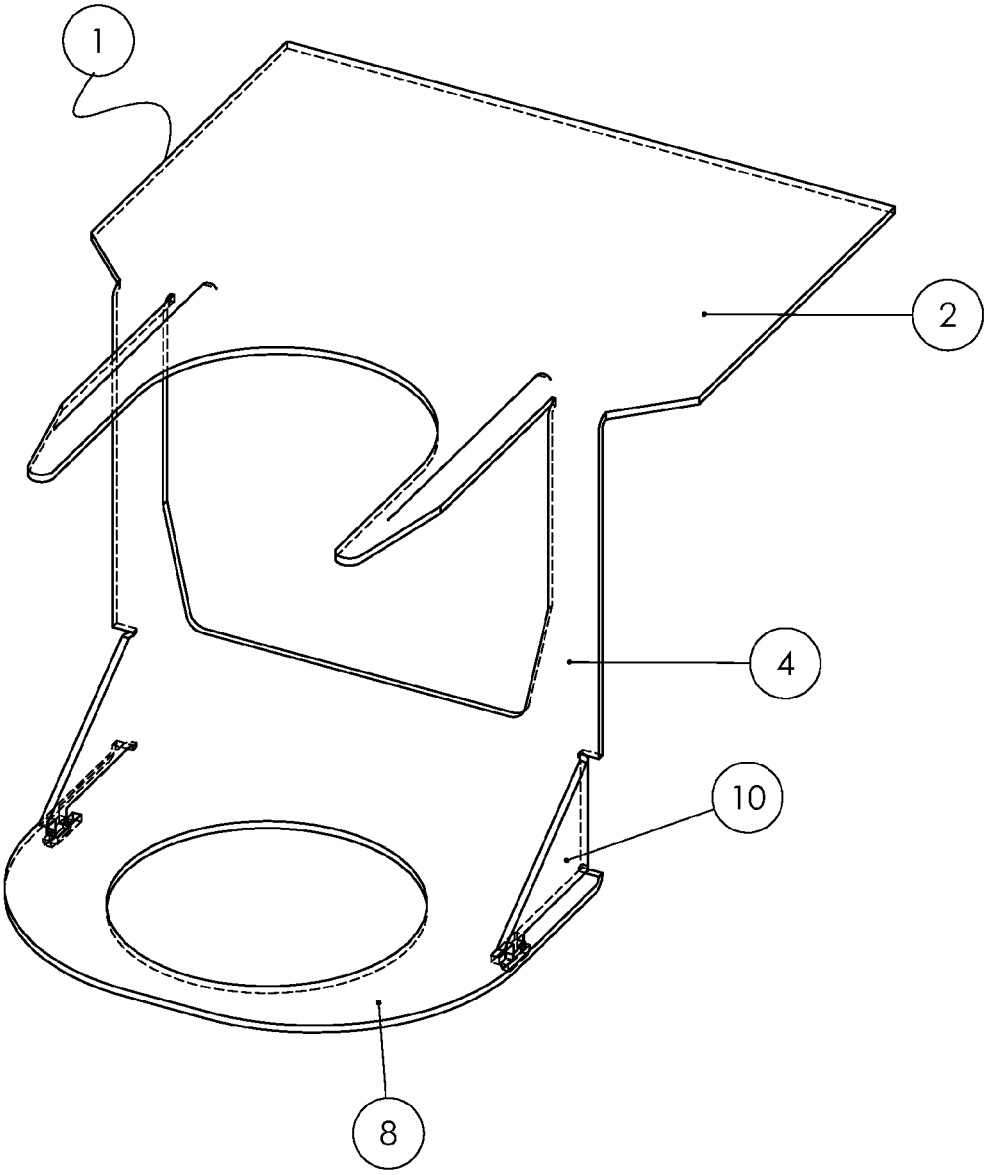
FIG. 10 is a perspective view(s) of the drinking cup holder and drip collector apparatus containing foldable gussets which can be secured into place by push-in tab, or other means.

In FIG. 10, for example, a foldable version drip cup/collector can be stamped or other means of a flat sheet for ease of sending to customer. The drip collector apparatus may contain foldable gussets 10 which can be secured into place by push-in tab, or other means into second, or lower, cup-holding member 8. The cup holding tabs 6 can also contain some means of re-enforcing rib or shape to stabilize/support the cup holding tabs 6 when dispensing fluids into the drinking cup C1.

Figure 11:
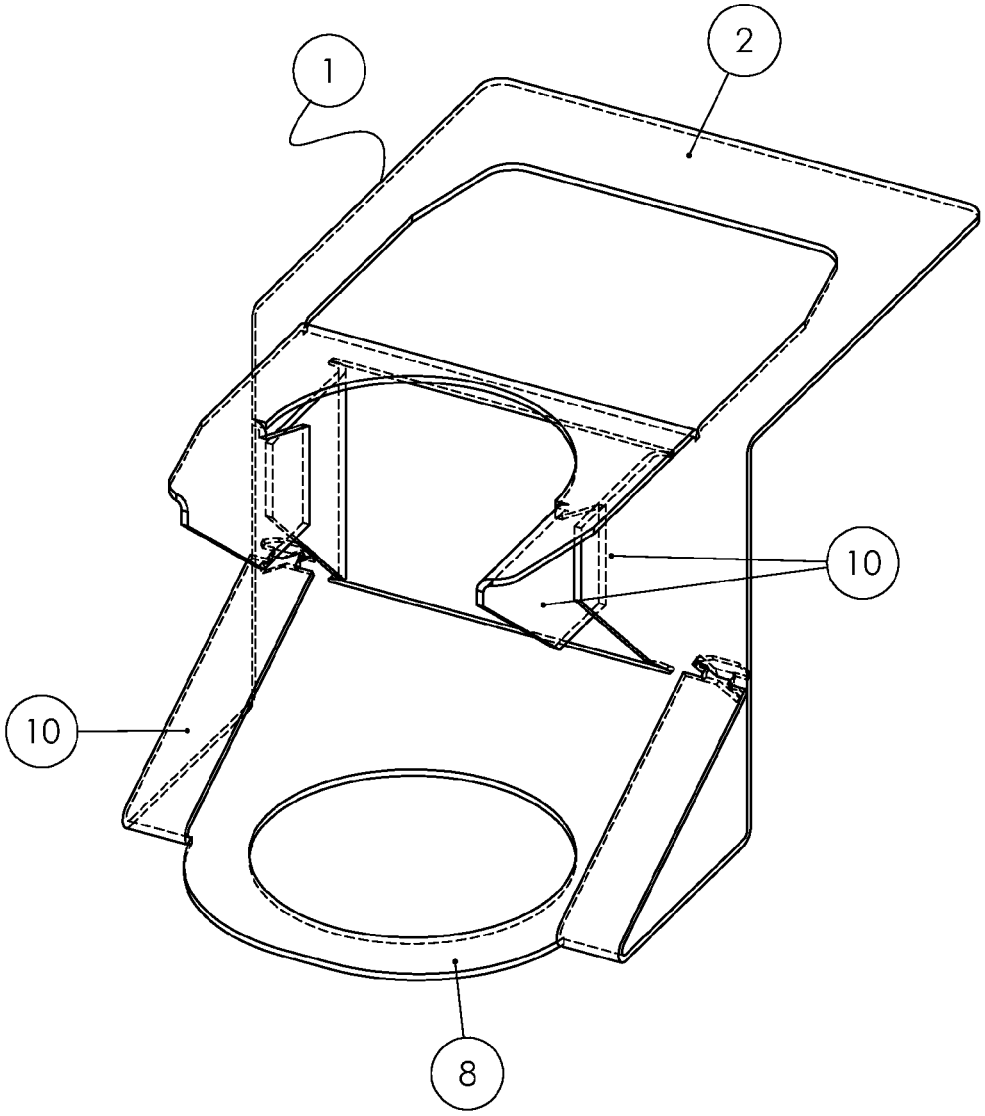
FIG. 11 is a perspective view(s) of the drinking cup holder and drip collector apparatus containing foldable gussets which can be secured into place by Velcro, or other means.

In FIG. 11, for example, a foldable version drip cup/collector can be stamped or other means of a flat sheet for ease of sending to customer. The drip collector apparatus may contain foldable gussets 10 which can be secured into place by push-in tab, or other means into front member 4. The cup holding tabs 6 can also contain some means of re-enforcing flange or shape to stabilize/support the cup holding tabs 6 when dispensing fluids into the drinking cup C1.

What is claimed is:

1. A combination dispenser cup holder and drip collection apparatus comprising, in combination:

a support member upon which a beverage dispenser having a spigot is placed;

a front member extending downwardly at a right angle from the support member and having a slot;

a first cup-holding member extending outwardly at a right angle from the front member and below the spigot, wherein the first cup-holding member comprises a fixed contoured tab and a movable contoured tab, and wherein the fixed and movable contoured tabs form an opening to receive a drinking cup into which liquid from the spigot may be dispensed;

a base slide having an upper end attached to the movable contoured tab and a lower end seated within the slot of the front member to permit movement of the movable contoured tab in a direction parallel to the front member to adjust the opening to accommodate drinking cups of variable size; and a second cup-holding member extending outwardly at a right angle from the front member and below the first cup-holding member, the second cup-holding member adapted to receive a drip collecting cup into which drips from the spigot may be collected when the drinking cup is not present in the first cup-holding member.

2. The apparatus of claim 1, wherein the second cup-holding member comprises two tabs contoured to hold the drip collecting cup in place.

3. The apparatus of claim 1, wherein at least one of the first cup-holding member and the second cup-holding member comprises a planar member having an opening therethrough to hold the respective drinking or drip collecting cup in place.

4. The apparatus of claim 1, wherein the drip collector support includes drip cup support fingers to support the drip collecting cup.

5. The apparatus of claim 1, further comprising at least one collet for cooperating with at least one of the first cup-holding member and the second cup-holding member to facilitate the holding of drinking or drip collecting cups of differing sizes.

6. The apparatus of claim 1, wherein one or more of the support member, the first cup-holding member, and the second cup-holding member include grip-enhancing texturized portions or regions.

7. The apparatus of claim 1, wherein the apparatus is formed of a single, unitary piece of material.

8. The apparatus of claim 1, wherein the apparatus is formed of multiple pieces of material.

9. The apparatus of claim 1 wherein the front member further comprises a tensioning member to secure the base slide at a particular location along the front member.

* * * * *